US010120295B2

(12) United States Patent
Ota et al.

(10) Patent No.: US 10,120,295 B2
(45) **Date of Patent: *Nov. 6, 2018**

(54) IMAGE FORMING APPARATUS

(71) Applicant: FUJI XEROX CO., LTD., Tokyo (JP)

(72) Inventors: Naoki Ota, Kanagawa (JP); Masataka Kuribayashi, Kanagawa (JP); Takafumi Koide, Kanagawa (JP); Yusuke Fukuda, Kanagawa (JP); Katsuyuki Kitajima, Kanagawa (JP); Yasuhisa Morooka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 105 days.

This patent is subject to a terminal disclaimer.

(21) Appl. No.: 15/423,343

(22) Filed: Feb. 2, 2017

(65) Prior Publication Data

US 2018/0004146 A1 Jan. 4, 2018

(30) Foreign Application Priority Data

Jul. 1, 2016 (JP) ..... 2016-132006

(51) Int. Cl.

| | |
|---|---|
| ***G03G 9/087*** | (2006.01) |
| ***G03G 15/20*** | (2006.01) |
| ***G03G 9/08*** | (2006.01) |
| ***G03G 15/00*** | (2006.01) |

(52) U.S. Cl.

CPC ..... *G03G 9/0821* (2013.01); *G03G 15/6585* (2013.01)

(58) Field of Classification Search

None

See application file for complete search history.

(56) References Cited

U.S. PATENT DOCUMENTS 7,291,436 B2 11/2007 Nakamura et al.
7,867,683 B2 * 1/2011 Ninomiya ..... G03G 9/0804 430/109.1

(Continued)

FOREIGN PATENT DOCUMENTS

JP 2005-266546 A 9/2005
JP 2005-308920 A 11/2005

(Continued)

*Primary Examiner* — Clayton E Laballe
*Assistant Examiner* — Leon W Rhodes, Jr.
(74) *Attorney, Agent, or Firm* — Oliff PLC

(57) ABSTRACT

An image forming apparatus includes a fixing unit that includes a heating and pressurizing member, and fixes the toner image by performing the operation of heating and pressurizing on the toner image on a recording medium twice or more times with the heating and pressurizing member, wherein the toner contains a toner particle which contains a binder resin containing a crystalline polyester resin, a colorant, and a release agent, and an external additive, and satisfies Expression: $2 \leq \tan \delta_{P1} \leq 2.5$, wherein $\tan \delta_{P1}$ represents a maximum value of a mechanical loss tangent existing in a range where a complex elastic modulus is from $1\times10^6$ Pa to $1\times10^8$ Pa, which is measured at an angular frequency of 6.28 rad/sec and a distortion amount of 0.3%.

11 Claims, 1 Drawing Sheet

(56) References Cited

U.S. PATENT DOCUMENTS

| | | | | |
|---|---|---|---|---|
| 7,995,959 | B2 * | 8/2011 | Nakamura | G03G 15/2064 399/341 |
| 9,075,366 | B2 * | 7/2015 | Taki | G03G 15/234 |
| 9,128,400 | B2 * | 9/2015 | Takahashi | G03G 9/0821 |

FOREIGN PATENT DOCUMENTS

| | | | | |
|---|---|---|---|---|
| JP | 2010079106 | A | * | 4/2010 |
| JP | 2010-127966 | A | | 6/2010 |

* cited by examiner

IMAGE FORMING APPARATUS

CROSS-REFERENCE TO RELATED APPLICATIONS

This application is based on and claims priority under 35 USC 119 from Japanese Patent Application No. 2016-132006 filed Jul. 1, 2016.

BACKGROUND

1. Technical Field

The present invention relates to an image forming apparatus.

2. Related Art

A method of visualizing image information, such as an electrophotographic method, is used in various technical fields in recent years. In the electrophotographic method, an electrostatic image is formed on a surface of an image holding member as image information through charging and electrostatic image forming. In addition, a toner image is developed on the surface of the image holding member by using a developer containing toner, then the toner image is transferred to a recording medium, and the toner image is fixed on the recording medium, thereby visualizing the image information as an image. Note that, as a method of fixing the image on the recording medium, a fixing method of performing a heating operation twice is tried.

SUMMARY

According to an aspect of the invention, there is provided an image forming apparatus including:

an image holding member;

a charge unit that charges a surface of the image holding member;

an electrostatic latent image forming unit that forms an electrostatic latent image on a charged surface of the image holding member;

a developing unit that contains a developer containing toner, and develops the electrostatic latent image formed on the surface of the image holding member with a developer containing a toner to form a toner image;

a transfer unit that transfers the toner image formed on the surface of the image holding member to a surface of a recording medium; and a fixing unit that includes a heating and pressurizing member, and fixes the toner image by performing the operation of heating and pressurizing on the toner image on the recording medium twice or more times with the heating and pressurizing member, wherein the toner contains a toner particle which contains a binder resin containing a crystalline polyester resin, a colorant, and a release agent, and an external additive, and satisfies the following Expression (1):

$$2 \leq \tan \delta_{P1} \leq 2.5 \quad (1)$$

wherein tan $\delta_{P1}$ represents a maximum value of a mechanical loss tangent existing in a range where a complex elastic modulus is from $1\times10^6$ Pa to $1\times10^8$ Pa, which is measured at an angular frequency of 6.28 rad/sec and a distortion amount of 0.3%.

BRIEF DESCRIPTION OF THE DRAWINGS

Exemplary embodiments of the present invention will be described in detail based on the following figures, wherein.

DETAILED DESCRIPTION

Figure 1:
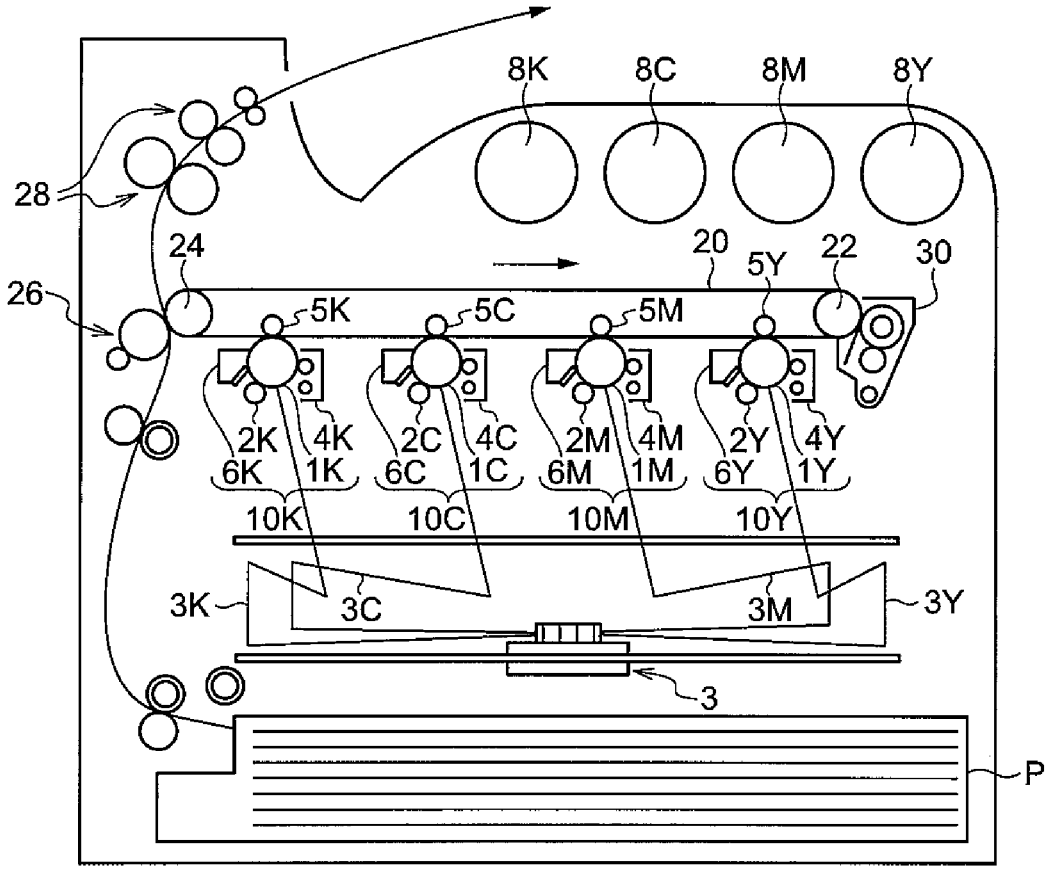
FIG. 1 illustrates the structure of an image forming apparatus according to an exemplary embodiment of the present invention.

Hereinafter, the exemplary embodiment which is an example of the invention will be specifically described.

Image Forming Apparatus

An image forming apparatus according to an exemplary embodiment includes an image holding member, a charge unit that charges a surface of the image holding member, an electrostatic image forming unit that forms an electrostatic image on the charged surface of the image holding member, a developing unit that contains an electrostatic charge image developer containing a toner for developing electrostatic image (hereinafter, also simply referred to as "toner"), and develops the electrostatic image formed on the image holding member as a toner image by the toner, a transfer unit that transfers the toner image formed on the image holding member to a surface of a recording medium, and a fixing unit that fixes the toner image on the recording medium.

In addition, the fixing unit includes a heating and pressurizing member for heating and pressurizing by contacting with the toner image, and fixes the toner image on the recording medium by performing an operation of heating and pressurizing twice or more times on the toner image by using the heating and pressurizing member.

The toner contains the binder resin containing the crystalline polyester resin, and the maximum value (tan $\delta_{P1}$) of a mechanical loss tangent of the toner is from 2 to 2.5 when the complex elastic modulus is in a range of $1\times10^6$ Pa to $1\times10^8$ Pa which is measured at an angular frequency of 6.28 rad/sec and a strain amount of 0.3%.

With such a configuration, in the image forming apparatus according to the exemplary embodiment, it is possible to prevent the attachment of the toner (offset) with respect to the heating and pressurizing member even with the multistage fixing method (a method of fixing a toner image by performing an operation of heating and pressurizing twice or more times), and to obtain a high gloss image.

Although the reason is not clear, the following reasons may be presumed.

In the related art, the fixing is performed according to a fixing method (a multistage fixing method) of performing the operation of heating and pressurizing twice or more times by contacting the toner image on the recording medium with the heating and pressurizing member twice or more times. Particularly, in order to improve the glossiness of the image, a multistage fixing method in which a fixing function is added to the first stage heating and pressurizing operation, and a function of improving the glossiness is added to the second stage heating and pressurizing operation is preferably used. For example, as the thickness of the recording medium becomes larger, it is hard to improve the glossiness of the image, and thus an effect of improving the glossiness of the image according to the above-described multistage fixing method is further exhibited.

However, in a multistage fixing-type image forming apparatus, it is considered that when the toner contacts with the heating and pressurizing member plural times, the melted toner tends to have a further enhanced adhesive force, thereby causing the toner to be liable to adhere. As a result, it is presumed that the offset occurs at the time of contacting with the heating and pressurizing member at the second and subsequent stages.

In contrast, as a toner according to the exemplary embodiment, usable is a toner having a maximum value (tan $\delta_{P1}$) of the mechanical loss tangent in a range of 2 to 2.5 when the complex elastic modulus is in a range of $1\times10^6$ Pa to $1\times10^8$ Pa, which is measured under the conditions of an angular frequency of 6.28 rad/sec and a strain amount of 0.3%.

The fact that the maximum value (tan $\delta_{P1}$) of the mechanical loss tangent in a state where the complex elastic modulus which is measured under the above-described conditions is in the above-described range is 2 or more is an indicator showing that the elasticity is dominant in viscoelasticity of the toner, that is, the toner is hard to be softened, and is hard to melted in a state where the operation of heating and pressurizing is performed by the heating and pressurizing member. Therefore, the melting viscosity is prevented from being decreased and the occurrence of cold offset is prevented, and the surface properties is prevented from being decreased and a high gloss image may be obtained.

On the other hand, it is presumed that when the maximum value (tan $\delta_1$) of the mechanical loss tangent is set to 2.5 or less, in the multistage fixing-type image forming apparatus, an adhesive force is prevented from being enhanced and the toner is prevented from easily adhering at the time of contacting with the heating and pressurizing member at the second and subsequent stages, and as a result, the attachment of the toner (offset) with respect to the heating and pressurizing member is prevented.

Note that, the heating and pressurizing member in the exemplary embodiment means a member that heats and pressurizes the toner image transferred to the surface of the recording medium. Examples thereof include a heating and pressurizing roller that performs heating and pressurizing by inserting the recording medium on which the toner image is formed on the surface between a pair of rollers which contact with each other and may add the heat from at least one roller among the pair of rollers.

In addition, the multistage fixing method (a method of fixing a toner image by performing an operation of heating and pressurizing twice or more times) may have a configuration in which, with two or more heating and pressurizing members, the recording medium passes once through each of contact portions of the plural heating and pressurizing members, or may have a configuration in which, with one heating and pressurizing member, the recording medium repeatedly passes through the contact portion of the heating and pressurizing member twice or more times. Here, in order to improve the glossiness of image, the configuration in which, with two or more heating and pressurizing members, the recording medium passes once through each of contact portions of the plural heating and pressurizing members is preferably used.

Hereinafter, the image forming apparatus according to the exemplary embodiment will be specifically described.

Toner for Developing Electrostatic Image

First, in the exemplary embodiment, a toner which is contained in a developing device and is used in a developing step will be specifically described.

The toner in the exemplary embodiment contains the binder resin containing the crystalline polyester resin, and has a maximum value (tan $\delta_{P1}$) of a mechanical loss tangent in a range of 2 to 2.5 when the complex elastic modulus is in a range of $1\times10^6$ Pa to $1\times10^8$ Pa, which is measured at an angular frequency of 6.28 rad/sec and a strain amount of 0.3%.

Maximum Value (Tan $\delta_{P1}$ and Tan $\delta_{P2}$) of Mechanical Loss Tangent The toner in the exemplary embodiment preferably has the maximum value (tan $\delta_{P1}$) of the mechanical loss tangent in a range of 2 to 2.5 when the complex elastic modulus is in a range of $1\times10^6$ Pa to $1\times10^8$ Pa, which is measured under the conditions of the angular frequency of 6.28 rad/sec and the strain amount of 0.3%. Note that, the maximum value (tan $\delta_{P1}$) of the mechanical loss tangent is preferably in a range of 2 to 2.3.

When the maximum value (tan $\delta_{P1}$) of the mechanical loss tangent is 2 or more, the occurrence of the cold offset is prevented and a high gloss image is obtained.

On the other hand, even with the multistage fixing-type image forming apparatus, the attachment of the toner (offset) is prevented with respect to the heating and pressurizing member by setting the maximum value (tan $\delta_{P1}$) of the mechanical loss tangent to be 2.5 or less.

The toner in the exemplary embodiment preferably has the maximum value (tan $\delta_{P2}$) of the mechanical loss tangent in a range of 2 to 2.3 when the complex elastic modulus is in a range of $1\times10^6$ Pa to $1\times10^7$ Pa, which is measured under the conditions of the angular frequency of 6.28 rad/sec and the strain amount of 0.3%, and is further preferably in a range of 2 to 2.2.

When the maximum value (tan $\delta_{P2}$) of the mechanical loss tangent is 2 or more, the occurrence of the cold offset is prevented and a high gloss image is obtained.

On the other hand, even with the multistage fixing-type image forming apparatus, the attachment of the toner (offset) is prevented with respect to the heating and pressurizing member by setting the maximum value (tan $\delta_{P2}$) of the mechanical loss tangent to be 2.3 or less.

Method of Measuring Mechanical Loss Tangent

Here, the calculation of the mechanical loss tangent value is performed based on the dynamic viscoelasticity measured according to a sinusoidal vibration method. In the measurement of the dynamic viscoelasticity, a measuring apparatus ARES manufactured by Rheometric Scientific Inc is used, and the dynamic viscoelasticity is measured by setting toner formed into a tablet is set on a parallel plate having a diameter of 8 mm, and imparting the sinusoidal vibration at a vibration frequency of 6.28 rad/sec to the plate after setting the normal force to be 0. The measurement is started at 60° C., and continued up to 150° C. The measurement time interval is set to be 30 seconds, the temperature rise is set to be 1° C./min, and the strain amount is set to be 0.3% so as to obtain the values of the complex elastic modulus and the mechanical loss tangent, and from the obtained values, the maximum value (tan $\delta_{P1}$) of the mechanical loss tangent when the complex elastic modulus is in a range of $1\times10^6$ Pa to $1\times10^8$ Pa, and the maximum value (tan $\delta_{P2}$) of the mechanical loss tangent when the complex elastic modulus is in a range of $1\times10^6$ Pa to $1\times10^7$ Pa are calculated.

Method of Controlling Maximum Values (Tan $\delta_{P1}$) and Tan $\delta_{P2}$) of Mechanical Loss Tangent A method of controlling the maximum value (tan $\delta_{P1}$) of the mechanical loss tangent and the maximum value (tan $\delta_{P2}$) of the mechanical loss tangent of the toner to be in the above-described ranges will be described. The control method is not particularly limited; however, in a case of obtaining toner according to an aggregation and coalescence method described later, a method of using a ester compound (for example, esters formed of higher alcohols having 12 to 30 carbon atoms and higher fatty acids having 12 to 30 carbon atoms, such as stearyl stearate, palmityl palmitate, behenyl behenate, and stearyl montanate; esters formed of higher fatty acids having 12 to 30 carbon atoms and lower monoalcohols, such as butyl stearate, isobutyl behenate, propyl montanate, and 2-ethylhexyl oleate; esters formed of higher fatty acid having to 30 carbon atoms and polyol such as montanic acid monoethylene glycol ester, ethylene glycol distearate, monostearic acid glyceride, monobehenic acid glyceride, tripalmitic acid glyceride, pentaerythritol monobehenate, pentaerythritol dilinoleate, pentaerythritol trioleate, and pentaerythritol tetrastearate; esters formed of higher fatty acids having 12 to 30 carbon atoms and a multimer of polyol, such as diethylene glycol monobehenate, diethylene glycol dibehenate, dipropylene glycol monostearate, distearic acid diglyceride, tetrastearic acid triglyceride, hexabehenic acid tetraglyceride, and decastearic acid deca glyceride; esters formed of higher fatty acids having 12 to 30 carbon atoms and a monomer or a multimer (a short-chain functional group may be contained) of polyol, such as glycerin monoacetomonostearate, glycerin monoacetomonolinoleate, and diglycerin monoacetodistearate; sorbitan higher fatty acid esters such as sorbitan monostearate, sorbitan dibehenate, and sorbitan trioleate; cholesterol higher fatty acid esters such as cholesteryl stearate, cholesteryl oleate, and cholesteryl linoleate) in a mixed dispersion in which a resin particle dispersion and the like are mixed with each other, and adjusting the amount at the time of forming aggregated particles.

The ester compound such as stearyl stearate is attached to the surface of the resin particle at the time of forming the aggregated particles, and reduces an apparent glass transition temperature of the surface so as to improve the stability of the aggregated particles and the responsiveness to heat of particles attached to the surface of resin. For this reason, it is considered that the maximum value (tan $\delta_{P1}$ and tan $\delta_{P2}$) of the mechanical loss tangent under the above-described conditions may be increased.

In addition, the ester compound may be set as an ester compound dispersion in which the ester compound is dispersed in advance, and the ester compound dispersion may be added into the mixture dispersion at the time of forming the aggregated particles.

In addition, examples of the control method also include a method of incorporating a metal oxide (for example, water glass, silica, alumina, titania, calcium carbonate, magnesium carbonate, tricalcium phosphate, and cerium oxide) in the mixed dispersion, with the amount at the time of forming aggregated particles being adjusted.

The metal oxide such as water glass tends to exist at an appropriate distance in the resin particle at the time of forming the aggregated particles, and therefore, acts to lower the viscosity of the resin molecules when being heated during the fixing. For this reason, the maximum values (tan $\delta_{P1}$ and tan $\delta_{P2}$) of the mechanical loss tangent are increased under the above-described conditions.

As a resin particle dispersion using the aggregation and coalescence method, a dispersion in which crystalline resin-amorphous resin mixed particles are dispersed is preferably used. The dispersion is obtained in such a manner that a crystalline resin containing a crystalline polyester resin and an amorphous resin are dispersed in a dispersion medium, and then, the dispersion medium containing the crystalline resin and the amorphous resin is subjected to the phase inversion emulsification. Since both the crystalline resin and the amorphous resin are dispersed in the dispersion medium and then the dispersion medium is subjected to the phase inversion emulsification, it is possible to obtain well-mixed crystalline resin-amorphous resin mixed particles as compared with a case where the crystalline resin and amorphous resin are independently dispersed in the dispersion mediums to prepare the respective dispersions and the dispersions are mixed and then subjected to the phase inversion emulsification.

Further, the maximum value (tan $\delta_P$ and tan $\delta_{P2}$) of the mechanical loss tangent is also adjusted by the ratio of the crystalline resin to the amorphous resin, the molecular amount of the crystalline resin or the amorphous resin, and the crosslinking degree.

Dynamic Complex Viscosity ($\eta^*_{-30}$ and $\eta^*_{-10}$)

The toner in the exemplary embodiment, the dynamic complex viscosity ($\eta_{-30}$) is $3\times10^7$ Pa·s or more under the condition of a temperature of (the melting temperature of a crystalline polyester resin contained in the toner −30° C.), and the dynamic complex viscosity ($\eta^*_{-10}$) is in a range of $1\times10^6$ Pa·s to $5\times10^7$ Pa·s under the condition of a temperature of (the melting temperature of a crystalline polyester resin −10° C.), but the following range is preferable.

The dynamic complex viscosity ($\eta^*_{-30}$) of the toner at a temperature of (the melting temperature of the crystalline polyester resin −30° C.) may be regarded as the dynamic complex viscosity of the toner in a state before being melted, that is, in a solid state; on the other hand, the dynamic complex viscosity ($\eta^*_{-10}$) at a temperature of (the melting temperature of the crystalline polyester resin −10° C.) may be regarded as the dynamic complex viscosity of the toner in a state of starting to be melted. In addition, in the toner, the fact that the dynamic complex viscosity ($\eta^*_{-30}$) in the solid state is equal to or greater than the above-described lower limit value, and the dynamic complex viscosity ($\eta^*_{-10}$) in the state of starting to be melted is in a range of the above-described range is an indicator that the toner is hard to be softened.

According to the exemplary embodiment, it is presumed that even in the multistage fixing-type image forming apparatus, an adhesive force is prevented from being enhanced, thereby preventing the toner from easily adhering at the time of contacting with the heating and pressurizing member at the second and subsequent stages, and as a result, the attachment of the toner (offset) with respect to the heating and pressurizing member is prevented.

When the dynamic complex viscosity ($\eta^*_{-30}$) of the toner at a temperature of (the melting temperature of the crystalline polyester resin −30° C.) is $3\times10^7$ Pa·s or more, the compatibility of the crystalline polyester resin with other resin is deteriorated, and thus a partial decrease in the glass transition temperature of the resin is prevented. For this reason, a difference hardly appears in the adhesion of the external additive on the toner surface, and for example, the occurrence of transfer unevenness is prevented, which is a preferable point.

Further, when the dynamic complex viscosity ($\eta^*_{-10}$) is $1\times10^6$ Pa·s or more at a temperature of (the melting temperature of the crystalline polyester resin −10° C.), the toner is hard to be melted even at the temperature close to the melting temperature, and the attachment of the toner (offset) tends to be prevented with respect to the heating and pressurizing member even with the multistage fixing-type image forming apparatus.

On the other hand, when the dynamic complex viscosity ($\eta^*_{-10}$) of the toner at a temperature of (the melting temperature of the crystalline polyester resin −10° C.) is $5\times10^7$ Pa·s or less, the fixing temperature of the entire toners is decreased to the proper temperature, and the surface gloss is appropriately controlled. Thus, it is possible to prevent the difference in gloss caused by the difference in the applied toner amount, which is a preferable point.

Note that, the dynamic complex viscosity ($\eta^*_{-10}$)) under the condition of a temperature of (the melting temperature of the crystalline polyester resin −10° C.) is preferably in a range of $2\times10^6$ Pa·s to $3\times10^7$ Pa·s, and more preferably in a range of $4\times10^6$ Pa·s to $2\times10^7$ Pa·s.

In addition, the dynamic complex viscosity ($\eta^*_{-30}$) at a temperature of (the melting temperature of the crystalline polyester resin −30° C.) is preferably $1\times10^8$ Pa·s or more, and more preferably $5\times10^8$ Pa·s or more.

Method of Measuring Dynamic Complex Viscosity

The measurement of the dynamic complex viscosity ($\eta^*$) is performed in such a manner that by using a rheometer, under the condition of frequency of 1 rad/second, and heating is performed at a heating rate of 1° C./minute from the melting temperature of the crystalline polyester resin contained in the toner, and the dynamic complex viscosity is measured for each degree. A measurement strain is set to be equal to or less than 20%, and parallel plates of 8 mmφ and 25 mmφ are separately used in accordance with a measurement torque.

Control Method of Dynamic Complex Viscosity ($\eta^*_{-30}$ and $\eta^*_{-10}$)

A method of controlling the dynamic complex viscosity ($\eta^*_{-30}$) and the dynamic complex viscosity ($\eta_{-10}$) in the toner to be in the above-described ranges is not particularly limited, and for example, in a case of a toner having a core-shell structure, there is a method by adjusting the ratio of the binder resin in a core and a shell and the molecular weight of the binder resin, particularly the molecular weight of the crystalline resin contained in the core. In addition, examples of the above-described method also include a method of adjusting the acid value of the crystalline resin, the presence or absence of the addition of a coagulant used in the aggregation and coalescence step at the time of preparing the toner, or a kind thereof.

From the viewpoint of controlling the dynamic complex viscosity ($\eta^*_{-30}$ and $\eta_{-10}$), a method of incorporating an ester compound such as stearyl stearate as described above and adjusting the amount thereof, and a method of incorporating the metal oxide such as the above-described water glass and adjusting the amount thereof are preferably used.

Further, from the viewpoint of controlling the dynamic complex viscosity ($\eta^*_{-30}$ and $\eta^*_{-10}$), as a resin particle dispersion using the aggregation and coalescence method, a dispersion in which crystalline resin-amorphous resin mixed particles are dispersed is preferably used. The dispersion is obtained by dispersing a crystalline resin containing a crystalline polyester resin and an amorphous resin in a dispersion medium, and then, performing the phase inversion emulsification on the dispersion medium.

Next, components of the toner in the exemplary embodiment will be described.

The toner according to the exemplary embodiment is formed of toner particles, and if necessary, an external additive.

Toner Particle

The toner particle is formed of a binder resin, and if necessary, a colorant, a release agent, and other additives. In addition, the binder resin contains at least a crystalline polyester resin.

Binder Resin

Examples of the binder resin include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and a modified rosin, a mixture thereof with the above-described vinyl resins, or a graft polymer obtained by polymerizing a vinyl monomer with the coexistence of such non-vinyl resins.

These binder resins may be used singly or in combination of two or more types thereof.

Examples of the crystalline polyester resin include a well-known polyester resin. The crystalline polyester resin may be used in combination with the amorphous polyester resin. The content of the crystalline polyester resin may be in a range of 2% by weight to 40% by weight (preferably in a range of 2% by weight to 20% by weight) with respect to the entirety of the binder resin.

Note that, "crystalline" of the resin means having not a stepwise endothermic change but a clear endothermic peak in the differential scanning calorimetry (DSC), and specifically, means that the half-value width of the endothermic peak is within 10° C. when measured at a heating rate of 10 (° C./min).

On the other hand, "amorphous" of the resin means that the half value width is higher than 10° C., the endothermic change is stepwise, or a clear endothermic peak is not recognized.

Amorphous Polyester Resin

Examples of the amorphous polyester resin include condensation polymers of polyvalent carboxylic acid and polyol. A commercially available product or a synthesized product may be used as the amorphous polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid having a crosslinked structure or a branched structure may be used in combination with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acid may be used singly or in combination of two or more types thereof.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are more preferably used as the polyol.

As the polyol, a tri- or higher-valent polyol having a crosslinked structure or a branched structure may be used in combination with diol. Examples of the tri- or higher-valent polyol include glycerin, trimethylolpropane, and pentaerythritol.

The polyol may be used singly or in combination of two or more types thereof.

The glass transition temperature (Tg) of the amorphous polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "Extrapolated glass transition onset temperature" described in the method of obtaining a glass transition temperature in JIS K 7121-1987 "Testing methods for transition temperatures of plastics".

The weight average molecular weight (Mw) of the amorphous polyester resin is preferably from 5,000 to 1,000,000, and more preferably from 7,000 to 500,000.

The number average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight average molecular weight and the number average molecular weight are measured by gel permeation chromatography (GPC). The molecular weight measurement by GPC is performed using GPC: HLC-8120 GPC, manufactured by Tosoh Corporation as a measuring device, column: TSK gel Super HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method may be used to prepare the amorphous polyester resin. Specific examples thereof include a method of conducting a reaction at a polymerization temperature set to be in a range of 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Crystalline polyester resin Examples of the crystalline polyester resin include a polycondensate of polyvalent carboxylic acid and polyol. Note that, as the crystalline polyester resin, a commercially available product may be used or, synthesized product may be used.

Here, the crystalline polyester resin easily forms a crystalline structure, and thus a polycondensate obtained by using a polymerizable monomer having a linear aliphatic group rather than a polymerizable monomer having an aromatic group is preferable.

Examples of the polyvalent carboxylic acid include aliphatic dicarboxylic acid (for example, oxalic acid, succinic acid, glutaric acid, adipic acid, suberic acid, azelaic acid, sebacic acid, 1,9-nonanedicarboxylic acid, 1,10-decanedicarboxylic acid, 1, 12-dodecanedicarboxylic acid, 1,14-tetradecanedicarboxylic acid, and 1,18-octadecanedicarboxylic acid), aromatic dicarboxylic acid (for example, dibasic acid such as phthalic acid, isophthalic acid, terephthalic acid, or naphthalene-2,6-dicarboxylic acid), anhydrides thereof, or lower alkyl esters (having, for example, from 1 to 5 carbon atoms) thereof.

As the polyvalent carboxylic acid, tri- or higher-valent carboxylic acid having a crosslinked structure or a branched structure may be used in combination with dicarboxylic acid. Examples of tri-valent carboxylic acid include aromatic carboxylic acids (for example, 1,2,3-benzenetricarboxylic acid, 1,2,4-benzenetricarboxylic acid, 1,2,4-naphthalenetricarboxylic acid), anhydrides thereof, or lower alkyl esters (having, for example, from 1 to 5 carbon atoms) thereof.

As the polyvalent carboxylic acid, a dicarboxylic acid having a sulfonic acid group or a dicarboxylic acid having an ethylenic double bond may be used together with the dicarboxylic acid.

The polyvalent carboxylic acid may be used singly or in combination of two or more types thereof.

Examples of the polyol include an aliphatic diol (for example, a linear aliphatic diol having a carbon number of 7 to 20 in the main chain portion). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, examples of the aliphatic diol preferably include 1,8-octanediol, 1,9-nonanediol, and 1,10-decanediol.

As the polyol, a tri- or higher-valent polyol having a crosslinked structure or a branched structure may be used in combination with diol. Examples of the tri- or higher-valent polyol include glycerin, trimethylolethane, trimethylolpropane, and pentaerythritol.

The polyol may be used singly or in combination of two or more types thereof.

Here, polyol may have the aliphatic diol of which the content is preferably 80 mol % or more, and further preferably 90 mol % or more.

The melting temperature of the crystalline polyester resin is preferably in a range of 50° C. to 100° C., is further preferably in a range of 55° C. to 90° C., and is still further in a range of 60° C. to 85° C.

Note that, the melting temperature is obtained from a DSC curve obtained by differential scanning calorimetry (DSC), and specifically obtained from "Melting peak temperature" described in the method of obtaining a melting temperature in JIS K 7121-1987 "Testing methods for transition temperatures of plastics".

The weight average molecular weight (Mw) of the crystalline polyester resin is preferably in a range of 6,000 to 35,000.

The crystalline polyester resin may be obtained according to a well-known preparing method similarly to the amorphous polyester resin.

The content of the binder resin is preferably from 40% by weight to 95% by weight, more preferably from 50% by weight to 90% by weight, and most preferably from 60% by weight to 85% by weight, with respect to the entirety of the toner particles.

Colorant

Examples of the colorant includes various types of pigments such as carbon black, chrome yellow, Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The colorant may be used singly or in combination of two or more types thereof.

As the colorant, if necessary, a surface-treated colorant may be used, or a dispersant may be used in combination. Further, as the colorant, plural types of colorants may be used in combination.

The content of the colorant is preferably in a range of 1% by weight to 30% by weight, and is further preferably in a range of 3% by weight to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably from 50° C. to 110° C., and more preferably from 60° C. to 100° C.

The melting temperature is obtained from a DSC curve obtained by differential scanning calorimetry (DSC), and specifically obtained from "Melting peak temperature" described in the method of obtaining a melting temperature in JIS K 7121-1987 "testing methods for transition temperatures of plastics".

The content of the release agent is preferably from 1% by weight to 20% by weight, and more preferably from 5% by weight to 15% by weight with respect to the entirety of the toner particles.

Other Additives

Examples of other additives include well-known additives such as a magnetic material, a charge-controlling agent, and an inorganic powder. These additives are contained in the toner particle as internal additives.

Properties of Toner Particles

The toner particles may be toner particles having a single-layer structure, or toner particles having a so-called core.shell structure composed of a core (core particle) and a coating layer (shell layer) coated on the core.

Here, the toner particles having a core.shell structure is preferably composed of, for example, a core containing a binder resin, and if necessary, other additives such as a colorant and a release agent and a coating layer containing a binder resin.

The volume average particle diameter (D50v) of the toner particles is preferably from 2 μm to 10 μm, and more preferably from 4 μm to 8 μm.

Various average particle diameters and various particle diameter distribution indices of the toner particles are measured using a COULTERMULTISIZER II (manufactured by Beckman Coulter, Inc.) and ISOTON-II (manufactured by Beckman Coulter, Inc.) as an electrolyte.

In the measurement, a measurement sample in a range of 0.5 mg to 50 mg is added to 2 ml of a 5% aqueous solution of surfactant (preferably sodium alkylbenzene sulfonate) as a dispersing agent. The obtained material is added to the electrolyte in a range of 100 ml to 150 ml.

The electrolyte in which the sample is suspended is subjected to a dispersion treatment using an ultrasonic disperser for 1 minute, and a particle diameter distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

The average circularity of the toner particles is preferably in a range of 0.94 to 1.00, and is further preferably in a range of 0.95 to 0.98.

The average circularity of the toner particles is calculated by (circumference length of circle equivalent diameter)/(circumference length) [(circumference length of circle having the same projection area as that of particle image)/(circumference length of particle projected image)]. Specifically, the aforementioned value is measured according to the following method.

The average circularity of the toner particles is calculated by using a flow particle image analyzer (measured by FPIA-2100 manufactured by Sysmex Corporation), which first, suctions and collects the toner particles to be measured so as to form flat flow, then captures a particle image as a static image by instantaneously emitting strobe light, and then performs image analysis of the obtained particle image. 3,500 particles are sampled for calculating the average circularity.

In a case where the toner contains an external additive, the toner (the developer) to be measured is dispersed in the water containing a surfactant, and then the water is subjected to an ultrasonic treatment so as to obtain the toner particles in which the external additive is removed.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)$ n, $Al_2O_3.2SiO_2$, $CaCO_3$m $MgCO_3$, $BaSO_4$, and $MgSO_4$.

Surfaces of the inorganic particles as an external additive are preferably treated with a hydrophobizing agent. The hydrophobizing treatment is performed by, for example, dipping the inorganic particles in a hydrophobizing agent. The hydrophobization treating agent is not particularly limited and examples thereof include a silane coupling agent, silicone oil, a titanate coupling agent, and an aluminum coupling agent. These may be used alone or in combination of two or more kinds thereof.

Generally, the amount of the hydrophobization treating agent is, for example, from 1 part by weight to 10 parts by weight with respect to 100 parts by weight of the inorganic particles.

Examples of the external additive include a resin particle (resin particle such as polystyrene, polymethyl methacrylate (PMMA), and melamine resin), a cleaning aid (for example, metal salts of higher fatty acids typified by zinc stearate, and particles having fluorine high molecular weight polymer).

The amount of the external additive is, for example, preferably in a range of 0.01% by weight to 5% by weight, and is further preferably in a range of 0.01% by weight to 2.0% by weight with respect to the toner particles.

Preparing Method of Toner

Next, the method of preparing the toner will be described.

The toner is obtained by additionally adding the external additive to the toner particles after preparing the toner particles.

The toner particles may be prepared according to any one of a drying method (for example, a kneading and pulvering method) a wetting method (for example, an aggregation and coalescence method, a suspension polymerization method, and a dissolution suspension method). The preparing method of the toner particles is not particularly limited, and well-known method may be employed.

Among them, the toner particles may be suitably obtained according to the aggregation and coalescence method.

In addition, from the viewpoint of adjusting the maximum value (tan $\delta_{P1}$ and tan $\delta_{P2}$) of the above-described mechanical loss tangent and the dynamic complex viscosity ($\eta^*_{-30}$ and $\eta^*_{-10}$) of the toner to be in the above-described ranges, as a resin particle dispersion to be used according to the aggregation and coalescence method, a dispersion in which crystalline resin-amorphous resin mixed particles are dispersed is preferably used. The dispersion is obtained in such a manner that a crystalline resin containing a crystalline polyester resin and an amorphous resin are dispersed in a dispersion medium, and then, the dispersion medium containing the crystalline resin and the amorphous resin is subjected to the phase inversion emulsification.

Further, in a case where the toner is obtained according to the aggregation and coalescence method, at the time of forming aggregated particles, a method of incorporating an ester compound such as stearyl stearate as described above and adjusting the amount thereof, and a method of incorporating the metal oxide such as the above-described water glass and adjusting the amount thereof are preferably used.

Specifically, for example, in a case where the toner particles are prepared according to the aggregation and coalescence method, the toner particles are prepared through the steps. The steps include a step (a resin particle dispersion preparing step) of preparing a resin particle dispersion in which resin particles constituting the binder resin are dispersed, a step (an aggregated particles forming step) of forming aggregated particles by aggregating the resin particles (other particles if necessary), in the resin particle dispersion (in the dispersion in which other particle dispersions are mixed, if necessary); and a step (a coalescence step) of coalescing aggregated particles by heating an aggregated particle dispersion in which aggregated particles are dispersed so as to form toner particles.

Hereinafter, the respective steps will be described in detail.

In the following description, a method of obtaining toner particles including the colorant and the release agent will be described; however, the colorant and the release agent are used if necessary. Other additives other than the colorant and the release agent may also be used.

Resin Particle Dispersion Preparing Step

First, along with a resin particle dispersion in which the binder resin particles are dispersed, for example, a colorant particle dispersion in which colorant particles are dispersed and a release agent particle dispersion in which the release agent particles are dispersed are prepared.

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchange water, or the like, alcohols, and the like. The medium may be used singly or in combination of two or more types thereof.

Examples of the surfactant include an anionic surfactant such as sulfate, sulfonate, phosphate, and soap; a cationic surfactant such as amine salt and quaternary ammonium salt; and a nonionic surfactant such as polyethylene glycol, alkyl phenol ethylene oxide adduct, and polyol. Among them, the anionic surfactant and the cationic surfactant are particularly preferable. The nonionic surfactant may be used in combination with the anionic surfactant or the cationic surfactant.

The surfactant may be used singly or in combination of two or more types thereof.

Regarding the resin particle dispersion, as a method of dispersing the resin particles in the dispersion medium, a general dispersing method using, for example, a rotary shearing-type homogenizer, or a ball mill, a sand mill, or a DYNO mill, is exemplified. Depending on the type of the resin particles, the resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to the organic continuous phase (O phase); and adding an aqueous medium (W phase) to thereby form a discontinuous phase and convert the resin (so-called phase inversion) from W/O to O/W, thus dispersing the resin as particles in the aqueous medium.

In addition, in a case where the phase inversion emulsification method is used, a dispersion in which a crystalline resin and an amorphous resin are dispersed is preferably used. The above dispersion in which a crystalline resin and an amorphous resin are dispersed is obtained in such a manner that the crystalline resin and the amorphous resin are dispersed in the dispersion medium, and then, the dispersion medium containing the crystalline resin and the amorphous resin is subjected to the phase inversion emulsification.

The volume average particle diameter of the resin particles dispersed in the resin particle dispersion is, for example, preferably from 0.01 μm to 1 μm, more preferably from 0.08 μm to 0.8 μm, and most preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is measured as a volume average particle diameter D50v. The volume average particle diameter of the particles in other dispersion liquids is also measured in the same manner.

The content of the resin particles contained in the resin particle dispersion is, for example, preferably in a range of 5% by weight to 50% by weight, and further preferably in a range of 10% by weight to 40% by weight.

For example, the colorant particle dispersion and the release agent particle dispersion are also prepared in the same manner as in the case of the resin particle dispersion. That is, the resin particles in the resin particle dispersion are the same as the particles of the colorant dispersed in the colorant dispersion, and the release agent particle dispersed in the release agent particle dispersion, in terms of the volume average particle diameter, the dispersion medium, the dispersing method, and the content of the particles in the resin particle dispersion.

The colorant particle dispersion and the release agent particle dispersion are also prepared in the same manner as in the case of the resin particle dispersion. That is, the volume average particle diameter, the dispersion medium, the dispersing method, and the content of the particles with respect to the resin particles in the resin particle dispersion described above may be applied to those of the colorant particles dispersed in the colorant particle dispersion and the release agent particles dispersed in the release agent particle dispersion.

Aggregated Particles Forming Step

Next, the resin particle dispersion, the colorant particle dispersion, and the release agent particle dispersion are mixed with each other.

The resin particles, the colorant particles, and the release agent particle are heterogeneously aggregated in the mixed dispersion, thereby forming aggregated particles having a diameter near a target toner particle diameter and including the resin particles, the colorant particles, and the release agent particles.

In addition, in the aggregated particles forming step, it is preferred that an ester compound such as stearyl stearate or a metal oxide such as water glass is contained in the mixed dispersion in which the resin particle dispersion and the like are mixed with each other.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature of a glass transition temperature of the resin particles (specifically, for example, in a range of from a temperature 30° C. lower than the glass transition temperature to a temperature 10° C. lower than the glass transition temperature with respect to the resin particles) to aggregate the particles dispersed in the mixed dispersion, thereby forming the aggregated particles.

In the aggregated particle forming step, for example, the aggregating agent may be added at room temperature (for example, 25° C.) while stirring the mixed dispersion with a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant, an inorganic metal salt, a divalent or more metal complex, which has an opposite polarity to the polarity of the surfactant used as the dispersing agent to be added to the mixed dispersion. Particularly, when a metal complex is used as the aggregating agent, the amount of the surfactant to be used is reduced and charging characteristics are improved.

An additive for forming a complex or a similar bond with a metal ion contained in the aggregating agent may be used, if necessary. A chelating agent is suitably used as the additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably in a range of 0.01 parts by weight to 5.0 parts by weight, and more preferably in a range of 0.1 parts by weight or more and less than 3.0 parts by weight, with respect to 100 parts by weight of the resin particles.

Coalescence Step

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to perform the coalesce on the aggregated particles and form toner particles.

The toner particles are obtained through the foregoing steps.

Note that, the toner particles may be obtained through a step of forming second aggregated particles in such a manner that an aggregated particle dispersion in which the aggregated particles are dispersed is obtained, the aggregated particle dispersion and a resin particle dispersion in which resin particles are dispersed are mixed, and the mixtures are aggregated so that the resin particles are attached on the surface of the aggregated particle, and a step of forming the toner particles having a core/shell structure by heating a second aggregated particle dispersion in which the second aggregated particles are dispersed, thereby coalescing the second aggregated particles.

Here, after the coalescence step ends, the toner particles formed in the solution are subjected to a washing step, a solid-liquid separation step, and a drying step, which are well known, and thus dry toner particles are obtained.

In the washing step, displacement washing with ion exchange water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The toner according to the exemplary embodiment is prepared by adding and mixing, for example, an external additive to the obtained dry toner particles, if necessary. The mixing may be performed with, for example, a V-blender, a HENSCHEL mixer, a LÖDIGE MIXER, or the like. Furthermore, if necessary, coarse particles of the toner may be removed by using a vibration classifier, a wind classifier, or the like.

Electrostatic Charge Image Developer

The electrostatic charge image developer according to the exemplary embodiment includes at least the toner according to the exemplary embodiment.

The electrostatic charge image developer according to the exemplary embodiment may be a one-component developer containing only the toner according to the exemplary embodiment, or a two-component developer obtained by mixing the toner with a carrier.

The carrier is not particularly limited, and a well-known carrier may be used. Examples of the carrier include a coating carrier in which the surface of the core formed of magnetic particle is coated with the coating resin; a magnetic particle dispersion-type carrier in which the magnetic particle are dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which particles which form the above carrier are set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, and a straight silicone resin formed by containing an organosiloxane bond or the modified products thereof, a fluorine resin, polyester, polycarbonate, a phenol resin, and an epoxy resin.

Other additives such as the conductive particles may be contained in the coating resin and the matrix resin.

Examples of the conductive particle include metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution in the kneader coater and removing a solvent.

The mixing ratio (weight ratio) of the toner to the carrier in the two-component developer is preferably in a range of toner: carrier=1:100 to 30:100, and is further preferably in a range of 3:100 to 20:100.

Image Forming Apparatus

Next, a configuration of the image forming apparatus in the exemplary embodiment will be described.

As the image forming apparatus according to the exemplary embodiment, well-known image forming apparatuses such as an apparatus including a direct-transfer type apparatus that directly transfers the toner image formed on the surface of the image holding member to the recording medium; an intermediate transfer type apparatus that primarily transfers the toner image formed on the surface of the image holding member to a surface of an intermediate transfer member, and secondarily transfers the toner image transferred on the intermediate transfer member to the surface of the recording medium; an apparatus includes a cleaning unit that cleans the surface of the image holding member before being charged and after transferring the toner image; and an apparatus includes an erasing unit that erases charges by irradiating the surface of the image holding member with erasing light before being charged and after transferring the toner image.

In a case where the intermediate transfer type apparatus is used, the transfer unit is configured to include an intermediate transfer member of which the toner image is to be transferred to the surface, a primary transfer unit that primarily transfers the toner image formed on the surface of the image holding member to the surface of the intermediate transfer member, and a secondary transfer unit that secondarily transfers the toner image transferred on the surface of the intermediate transfer member to the surface of the recording medium.

In the image forming apparatus according to the exemplary embodiment, for example, a unit including the developing unit may be a cartridge structure (process cartridge) which is detachable from the image forming apparatus. As a process cartridge, for example, a process cartridge including the developing unit which contains the electrostatic charge image developer in the exemplary embodiment is preferably used.

In addition, in the image forming apparatus according to the exemplary embodiment, a fixing method (multistage fixing method) in which the heating and pressurizing member contacts with the toner image on the recording medium twice or more, and an operation of heating and pressurizing is performed twice or more times is employed. Particularly, in order to improve the glossiness of the image, a multistage fixing method in which a fixing function is added to the first stage heating and pressurizing operation, and a function of improving the glossiness is added to the second stage heating and pressurizing operation is preferably used. For example, as the thickness of the recording medium becomes larger, it is hard to improve the glossiness of the image, and thus an effect of improving the glossiness of the image according to the above-described multistage fixing method is further exhibited.

Hereinafter, an example of the image forming apparatus of the exemplary embodiment will be described; however, the invention is not limited thereto. Note that, in the drawing, major portions will be described, and others will not be described.

FIG. 1 is a configuration diagram schematically illustrating the image forming apparatus according to the exemplary embodiment.

The image forming apparatus as illustrated in FIG. 1 is provided with electrophotographic type first to fourth image forming units 10Y, 10M, 10C, and 10K (image forming unit) that output an image for each color of yellow (Y), magenta (M), cyan (C), and black (K) based on color separated image data. These image forming units 10Y, 10M, 10C, and 10K (hereinafter, simply referred to as a "unit" in some cases) are arranged apart from each other by a predetermined distance in the horizontal direction. Note that, the units 10Y, 10M, 10C, and 10K may be the process cartridge which is detachable from the image forming apparatus.

As an intermediate transfer member, an intermediate transfer belt 20 passing through the respective units is extended upward in the drawing of the respective units 10Y, 10M, 10C, and 10K. The intermediate transfer belt 20 is provided to be wound onto a support roller 24 which contacts with the inner surface of an intermediate transfer belt 20 and a driving roller 22, which are disposed apart from each other in the horizontal direction in the drawing, and travels to the direction from the first unit 10Y to the fourth unit 10K. In addition, a force is applied to the support roller 24 in the direction apart from the driving roller 22 by a spring (not shown), and thus a tension is applied to the intermediate transfer belt 20 which is wound by both. Further, an intermediate transfer member cleaning device 30 is provided on the side surface of the image holding member of the intermediate transfer belt 20 so as to face the driving roller 22.

In addition, four colors toner of yellow, magenta, cyan, and black stored in toner cartridges 8Y, 8M, 8C, and 8K are correspondingly supplied to each of developing devices (an example of the developing unit) 4Y, 4M, 4C, and 4K of the each of the units 10Y, 10M, 10C, and 10K.

The first to fourth units 10Y, 10M, 10C, and 10K have the same configuration as each other, and thus the first unit 10Y for forming a yellow image disposed on the upstream side the travel direction of the intermediate transfer belt will be representatively described. Note that, the description for the second to fourth units 10M, 10C, and 10K will be omitted by denoting reference numeral with magenta (M), cyan (C), and black (K) instead of yellow (Y) to the same part as that of the first unit 10Y.

The first unit 10Y includes a photoreceptor 1Y serving as an image holding member. In the vicinity of the photoreceptor 1Y, a charging roller (an example of the charge unit) 2Y which charges the surface of the photoreceptor 1Y with a predetermined potential, an exposure device (an example of the electrostatic image forming unit) 3 which exposes the charged surface by using a laser beam 3Y based on color separated image signal so as to form an electrostatic image, a developing device (an example of the developing unit) 4Y which supplies the charged toner to the electrostatic image and develops the electrostatic image, a primary transfer roller 5Y (an example of the primary transfer unit) which transfers the developed toner image onto the intermediate transfer belt 20, and a photoreceptor cleaning device (an example of the cleaning unit) 6Y which removes the residues remaining on the surface of the photoreceptor 1Y after primary transfer are sequentially disposed.

Note that, the primary transfer roller 5Y is disposed inside the intermediate transfer belt 20, and is provided at a position facing the photoreceptor 1Y. Further, bias power supply (not shown) which is applied to the primary transfer bias is connected to each of the primary transfer rollers 5Y, 5M, 5C, and 5K. The bias power supply is changed to the transfer bias which is applied to the primary transfer roller by control of a control unit (not shown).

Hereinafter, an operation of forming a yellow image in the first unit 10Y will be described.

First, before starting the operation, the surface of the photoreceptor 1Y is charged with the potential in a range of −600 V to −800 V by the charging roller 2Y.

The photoreceptor 1Y is formed by stacking the photosensitive layers on the conductive substrate (for example, volume resistivity of $1\times10^{-6}$ Ωcm or less at 20° C.). The photosensitive layer typically has high resistance (the resistance of the typical resin), but when being irradiated with the laser beam 3Y, it has the property of changing the resistivity of a portion which is irradiated with the laser beam. In this regard, in accordance with image data for yellow transmitted from the control unit (not shown), the laser beam 3Y is output to the charged surface of the photoreceptor 1Y via the exposure device 3. The surface of the photoreceptor 1Y is irradiated with the laser beam 3Y, and thereby, the electrostatic image of a yellow image pattern is formed on the surface of the photoreceptor 1Y.

The electrostatic image means an image formed on the charged surface of the photoreceptor 1Y, in which resistivity of a portion of the photosensitive layer to be irradiated with the laser beam 3Y is decreased, and the charges for charging the surface of the photoreceptor 1Y flow; on the other hand, electrostatic image means a so-called negative latent image which is formed when charges of a portion which is not irradiated with the laser beam 3Y remain.

The electrostatic image formed on the photoreceptor 1Y is rotated to the predetermined developing position in accordance with the traveling of the photoreceptor 1Y. Further, the electrostatic image on the photoreceptor 1Y is visualized (developed) in the developing position as a toner image by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is charged on the photoreceptor 1Y, and is thus held on the developer roller (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by a photoreceptor cleaning device 6Y.

The primary transfer biases that are applied to the primary transfer rollers 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roller 24 contacting the inner surface of the intermediate transfer belt, and a secondary transfer roller (an example of the secondary transfer unit) 26 disposed on the image holding surface side of the intermediate transfer belt 20. Meanwhile, a recording sheet (an example of the recording medium) P is supplied to a gap between the secondary transfer roller 26 and the intermediate transfer belt 20, that contact with each other, via a supply mechanism at a predetermined timing, and a secondary transfer bias is applied to the support roller 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detecting unit (not shown) that detects the resistance of the secondary transfer part, and is voltage-controlled.

Thereafter, the recording sheet P is fed to a fixing device (an example of the fixing unit) 28 so that the toner image is fixed to the recording sheet P, whereby a fixed image is formed. In addition, a fixing method (a multistage fixing method) of causing the heating and pressurizing member to contact with the toner image on the recording medium twice or more, and performing the operation of heating and pressurizing twice or more times is employed in the exemplary embodiment.

Figure 2:
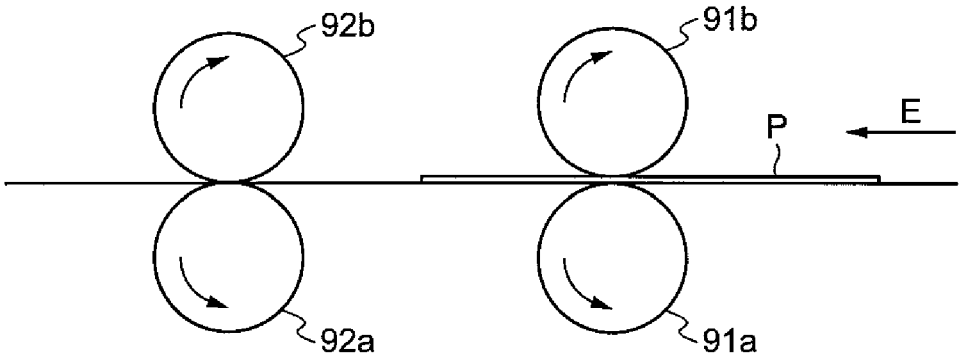
FIG. 2 illustrates the structure of a multistage fixing-type fixing device in the exemplary embodiment.

FIGS. 1 and 2 illustrate an example of the multistage fixing-type fixing device which fixes the toner image by performing the operation of heating and pressurizing twice. Reference numerals 91*a* and 91*b* represent a pair of fixing rollers (an example of the heating and pressurizing member at the first stage) at a first stage, and the first stage fixing is performed in such a manner that the recording sheet P on which the toner image before being fixed is formed is transported to an arrow direction E, the recording sheet P passes between the pair of fixing rollers 91*a* and 91*b*, and the toner image is heated.

Next, the second stage fixing is performed in such a manner that the recording sheet P on which is the first stage fixing is performed passes through between, a pair of fixing rollers of 92*a* and 92*b* at a second stage (an example of the heating and pressurizing member at the second stage), and the fixed toner image is further subjected to the heating and pressurizing. Particularly, it is preferable that the glossiness of image is improved by the second stage fixing.

In this regard, the configuration of the pair of fixing rollers will be described.

The fixing rollers 91*b* and 92*b* which are to directly contact with the toner image are formed into a cylindrical shape, and an outermost layer thereof contacts with the surface of the toner image on the recording sheet P so as to perform the heating and pressurizing, and thereby the toner image is fixed on the recording sheet P. The fixing rollers 91*b* and 92*b* may have a multilayer structure including a core roller and an elastic layer from radially inward to outward. Note that, the elastic layer may further include an outermost layer on the outside thereof.

The core roller is a cylindrical member that supports the elastic layer and the outermost layer disposed on the outer peripheral surface. The core roller has a configuration in which a hub (a part to which a bearing is to be attached) formed of SUS (stainless steel) is provided at both axial end portions of a pipe material formed of an aluminum alloy, for example. Here, the material of the core roller is not limited thereto, and may be formed of other materials. Examples the material of the core roller include metal such as aluminum (A-5052 material and the like), iron, SUS, and copper, an alloy, ceramics, and FRM (fiber reinforced metal). In addition, the shape of the core roller is not limited to the cylindrical shape (hollow), but may be a columnar shape (solid).

Examples of the material of the elastic layer include urethane rubber, ethylene.propylene rubber (EPM), silicone rubber, and fluororubber (FKM), and particularly include silicone rubber excellent in heat resistance and processability. Example of the silicone rubber include RTV silicone rubber, HTV silicone rubber, and the like, and specifically include polydimethyl silicone rubber (MQ), methylvinyl silicone rubber (VMQ), methylphenyl silicone rubber (PMQ), fluorosilicone rubber (FVMQ), and the like.

Note that, an adhesive layer may be provided between the core roller and the elastic layer. In addition, the elastic layer may further include an outermost layer on the outside thereof.

Further, a halogen heater may be provided inside the fixing rollers 91*b* and 92*b* as an internal heat imparting unit. The halogen heater generates heat when energized from the power supply, and heats the fixing rollers 91*b* and 92*b* from the inside thereof.

Note that, a configuration in which a cleaning web contacts with the outer peripheral surface of the fixing rollers 91*b* and 92*b*, and the release agent attached on the outer peripheral surface of the fixing rollers 91*b* and 92*b* is removed may be employed.

Then, fixing rollers 91*a* and 92*a* which are not directly contact with the toner image are formed into a cylindrical shape, and an outermost layer thereof contacts with the surface opposite to the toner image surface of the recording sheet P and is pressurized (or heated and pressurized), and thereby the toner image is fixed on the recording sheet P. The fixing rollers 91*a* and 92*a* may have a multilayer structure including a core roller and an elastic layer from radially inward to outward. Note that, the elastic layer may further include an outermost layer on the outside thereof. In addition, the fixing rollers 91*a* and 92*a* may be pushed toward the fixing rollers 91*b* and 92*b* by using a pushing unit such as a spring. Examples of the core roller and the elastic layer preferably include the same materials as those of the above-described fixing rollers 91*b* and 92*b*. In addition, the fixing rollers 91*a* and 92*a* may be provided with an internal heat imparting unit such as a halogen heater inside thereof.

In addition, as an example of the multistage fixing-type fixing device, a configuration of having two pairs of fixing rollers is described with reference to the drawings; however, the multistage fixing-type fixing device in the exemplary embodiment is not limited thereto. For example, the heating and pressurizing member may be a heating and pressurizing member having a configuration in which a pair of a roll-shaped rotation member and a belt-shaped rotation member contact with each other so as to form a nip, and the recording sheet onto which the toner image is transferred is inserted into the nip. In addition, a heating and pressurizing member having a configuration in which a pair of two belt-shaped rotation members contact with each other so as to form a nip may be employed.

Further, the number of the heating and pressurizing members is not limited to two, but may be three or more.

In addition, in addition to a configuration in which two or more heating and pressurizing members are provided, and the recording sheet passes through each of the plural heating and pressurizing members once, a configuration in which one heating and pressurizing member is provided, and the recording sheet repeatedly passes through the heating and pressurizing member two or more times may be employed.

Examples of the recording sheet P, to which the toner image is transferred, include plain paper that is used in electrophotographic copying machine, printers, and the like, and as a recording medium, an OHP sheet is also exemplified other than the recording sheet P.

In order to further improve the smoothness of the image surface after fixing, the surface of the recording sheet P is also preferably smooth. For example, coated paper obtained by coating the surface of plain paper with resin or the like, art paper for printing, or the like is preferably used.

The recording sheet P on which the fixing of the color image is completed is discharged toward a discharge part, and a series of the color image forming operations end.

EXAMPLES

Hereinafter, the exemplary embodiment will be more specifically described with reference to Examples and Comparative Examples; however, the exemplary embodiment is not limited thereto.

Preparation of Toner 1

Preparation of Crystalline Resin (A)

First, 100 parts by weight of dimethyl sebacate, 67.8 parts by weight of hexane diol, and 0.10 parts by weight of dibutyl tin oxide are allowed to react with each other under nitrogen atmosphere at 185° C. for five hours in a three-necked flask while removing water generated during the reaction to the outside, then the temperature is increased to 220° C. while slowly reducing pressure, and the reaction is performed for six hours, followed by cooling. Thus, a crystalline resin (A) having the weight average molecular weight of 33,700 is prepared.

Note that, the melting temperature of the crystalline resin (A) is obtained from a DSC curve obtained by differential scanning calorimetry (DSC), and specifically obtained from "Melting peak temperature" described in the method of obtaining a melting temperature in JIS K 7121-1987 "Testing methods for transition temperatures of plastics", and the obtained melting temperature is 71° C.

Preparation of Amorphous Resin (1)

First, 60 parts by weight of dimethyl terephthalate, 82 parts by weight of dimethyl fumarate, 34 parts by weight of dodecenyl succinic anhydride, 137 parts by weight of bisphenol A ethylene oxide adduct, 191 parts by weight of bisphenol A propylene oxide adduct, and 0.3 parts by weight of dibutyl tin oxide are allowed to react with each other under nitrogen atmosphere at 180° C. for three hours in a three-necked flask while removing water generated during the reaction to the outside, the temperature is increased up to 240° C. while slowly reducing pressure, and the reaction is performed for two hours, followed by cooling. Thus, an amorphous resin (1) having the weight average molecular weight of 17,100 is prepared.

Preparation of Colorant Dispersion

Further, a colorant dispersion is prepared by mixing 50 parts by weight cyan pigment (copper phthalocyanine, C.I. Pigment blue 15:3, prepared by Dainichiseika Color & Chemicals Mfg. Co., Ltd.), 5 parts by weight of nonionic surfactant NONIPOL 400 (prepared by Kao Corporation), and 200 parts by weight of ion exchange water, dispersing the mixture for about one hour by using a high-pressure impact disperser ULTIMAIZER (HJP30006, manufactured by Sugino Machine Ltd.), and adjusting the moisture amount.

Preparation of Release Agent Dispersion

A release agent dispersion having a water amount adjusted such that the concentration of the release agent becomes 20% by weight in the dispersion in which the release agent having the volume average particle diameter of 250 nm is dispersed is prepared by heating a solution at 120° C., the solution being prepared by mixing 60 parts by weight of paraffin wax (HNP9, manufactured by Nippon Seiro, Co., Ltd., melting temperature of 77° C.), 4 parts by weight of anionic surfactant (NEOGEN RK, manufactured by Dai-Ichi Kogyo Seiyaku Co., Ltd.), and 200 parts by weight of ion exchange water, subjecting the solution to a dispersing treatment with a homogenizer (ULTRA-TURRAX T50, manufactured by IKA Ltd.), and then a dispersing treatment with MANTON-GAULIN high pressure homogenizer (manufactured by Manton Gaulin Mfg Company Inc) under the condition of 120° C., 350 kg/cm$^2$, and one hour.

Preparation of Ester Compound Dispersion 100 parts by weight of stearyl stearate (prepared by NOF Corporation), 55 parts by weight of methyl ethyl ketone, and parts by weight of n-propyl alcohol are put into a three-necked flask, the resin is dissolved in the three-necked flask while being stirred, 350 parts by weight of ion exchange water is added into the three-necked flask. Then, the resultant is dispersed by using a homogenizer (ULTRA-TURRAX T50, manufactured by IKA Ltd.), and removing the solvent is performed. The volume average particle diameter is 195 nm. An ester compound dispersion having the solid concentration of 25% is prepared by adding ion exchange water to the resultant.

Preparation of Crystalline Resin/Amorphous Resin Mixed Particle Dispersion (A1)

A crystalline resin/amorphous resin mixed particle dispersion (A1) in which crystalline resin/amorphous resin mixed particles having the volume average particle diameter of 158 nm are dispersed, and which has the solid concentration of 25% is prepared by putting 10 parts by weight of crystalline resin (A), 90 parts by weight of amorphous resin (1), 50 parts by weight of methyl ethyl ketone, and 15 parts by weight of isopropyl alcohol are put into the three-necked flask, dissolving the resin by heating at 60° C. while stirring, then adding 25 parts by weight of 10% ammonia aqueous solution into the three-necked flask, slowly adding further 400 parts by weight of ion exchange water into the three-necked flask to thereby perform a phase inversion emulsification, then reducing the pressure, and performing removing the solvent.

Preparation of Crystalline Resin/Amorphous Resin Mixed Particle Dispersion (A2)

An crystalline resin/amorphous resin mixed particle dispersion (A2) in which the crystalline resin/amorphous resin mixed particles having the volume average particle diameter of 155 nm are dispersed, and which has the solid concentration of 25% by weight is prepared in the same manner as in the preparation of the crystalline resin/amorphous resin mixed particle dispersion (A1) except that the amount of the crystalline resin (A) is changed from 10 parts by weight to 15 parts by weight, and the amount of the amorphous resin (1) is changed from 90 parts by weight to 85 parts by weight.

Preparation of Amorphous Resin Dispersion (A3)

An amorphous resin particle dispersion (A3) in which the crystalline resin/amorphous resin mixed particles having the volume average particle diameter of 175 nm are dispersed, and the solid concentration is 25% by weight is prepared in the same manner as in the preparation of the crystalline resin/amorphous resin mixed particle dispersion (A1) except that the amount of the crystalline resin (A) is changed from 10 parts by weight to 0 part by weight, and the amount of the amorphous resin (1) is changed from 90 parts by weight to 100 parts by weight.

Preparation of Toner 1

720 parts by weight of crystalline resin/amorphous resin mixed particle dispersion (A1), 50 parts by weight of the colorant dispersion, 70 parts by weight of the release agent dispersion, 0.9 parts by weight of ester compound dispersion, 2.5 parts by weight water glass (SNOWTEX OS (registered trademark) manufactured by Nissan Chemical Industries), and 1.5 parts by weight of cationic surfactant (SANISOL B50, prepared by Kao Corporation) are put into to a round stainless steel flask, 0.1 N sulfuric acid is added thereto to adjust pH to 3.8, 30 parts by weight of nitric acid aqueous solution having 10% by weight of concentration of polyaluminum chloride as coagulant is added into the flask, and then, the mixture is dispersed at 30° C. by using a homogenizer (ULTRA-TURRAX T50, manufactured by IKA Ltd.). The resultant is heated up to 40° C. at 1° C./min in oil bath for heating, held at 40° C. for 30 minutes, then 160 parts by weight of amorphous resin particle dispersion (A3) is slowly added into the dispersion, and further held for one hour.

After that, after adjusting pH to 7.0 by adding 0.1 N sodium hydroxide, the resultant is heated up to 95° C. at 1° C./min while continuously stirring, held for five hours, cooled up to 20° C. at speed of 20° C./min, filtrated, washed with ion exchange water, and then dried by a vacuum dryer so as to obtain a toner 1 having the volume average particle diameter of 6.1 μm.

Regarding the toner 1, the following physical property values are measured. The results are shown in Table 1 below.

Maximum value (tan $\delta_1$) of mechanical loss tangent when the complex elastic modulus is in a range of $1\times10^6$ Pa to $1\times10^8$ Pa, which is measured at an angular frequency of 6.28 rad/sec and a strain amount of 0.3%

Maximum value (tan $\delta p_2$) of the mechanical loss tangent when the complex elastic modulus is in a range of $1\times10^6$ Pa to $1\times10^7$ Pa, which is measured at an angular frequency of 6.28 rad/sec and a strain amount of 0.3%

Dynamic complex viscosity ($\eta^*_{-30}$) at a temperature of (the melting temperature of the crystalline polyester resin contained in the toner −30° C.)

Dynamic complex viscosity ($\eta^*_{-10}$) at a temperature of (the melting temperature of the crystalline polyester resin contained in the toner −10° C.)

In addition, all of the toners indicated in Table 1 are obtained by adding 1.2 parts by weight of commercially available fumed silica RX 50 (prepared by Nippon Aerosil Co., Ltd.) as an external additive to 100 parts by weight of the toner particles with a HENSCHEL mixer (MITSUI MIKE MACHINERY Co. Ltd.) under the conditions of peripheral speed: 30 m/s and 5 minutes.

Thereafter, a two-component developer is prepared by mixing 8 parts by weight of the toner to which the external additive is added, and 100 parts by weight of the carrier.

The carrier is obtained in the following manner. 100 parts by weight of ferrite particles (the volume average particle diameter: 50 μm), 14 parts by weight of toluene, and 2 parts by weight of styrene-methyl methacrylate copolymer (component ratio: styrene/methyl methacrylate=90/10, the weight average molecular weight Mw=80,000) are prepared, then these components except for ferrite particles are dispersed with stirring for 10 minutes with a stirrer so as to prepare a coating solution. Then, the coating solution and the ferrite particles are put into a vacuum degassing type kneader (manufactured by Inoue Seisakusho Co., Ltd), the mixture is stirred at 60° C. for 30 minutes, the pressure is reduced to further degas while warming up the mixture, so that the mixture is dried, and then classifying with a mesh of 105 μm is performed.

Preparation of Toner 2

A toner 2 is prepared in the same manner as in the preparation of the toner 1 except that the content of the ester compound dispersion used in the preparing of the toner 1 is changed from 0.9 parts by weight to 2.7 parts by weight.

Preparation of Toner 3

A toner 3 is prepared in the same manner as in the preparation of the toner 1 except that the contents of the ester compound dispersion and the water glass, which are used in the preparing of the toner 1, are respectively changed from 0.9 parts by weight to 2.7 parts by weight, and from 2.5 parts by weight to 5.0 parts by weight.

Preparation of Toner 4

A toner 4 is prepared in the same manner as in the preparation of the toner 1 except that the crystalline resin/amorphous resin mixed particle dispersion (A1) used in the preparing of the toner 1 is changed to the crystalline resin/amorphous resin mixed particle dispersion (A2), and the contents of the ester compound dispersion and the water glass, which are used in the preparing of the toner 1, are respectively changed from 0.9 parts by weight to 2.7 parts by weight, and from 2.5 parts by weight to 5.0 parts by weight.

Preparation of Toner 5

A toner 5 is prepared in the same manner as in the preparation of the toner 4 except that the content of the ester compound dispersion which is used in the preparing of the toner 4 is changed from 2.7 parts by weight to 9 parts by weight.

Preparation of Toner 6

A toner 6 is prepared in the same manner as in the preparation of the toner 4 except that the contents of the ester compound dispersion and the water glass, which are used in the preparing of the toner 4, are respectively changed from 2.7 parts by weight to 9 parts by weight, and from 5.0 parts by weight to 15.0 parts by weight.

Various Measurements

The calculation of the mechanical loss tangent value is performed based on the dynamic viscoelasticity measured according to a sinusoidal vibration method. In the measurement of the dynamic viscoelasticity, a measuring apparatus ARES manufactured by Rheometric Scientific Inc is used, and the dynamic viscoelasticity is measured by setting a toner formed into a tablet is set on a parallel plate having a diameter of 8 mm, and imparting the sinusoidal vibration at a vibration frequency of 6.28 rad/sec to the plate after setting the normal force to be 0. The measurement is started at 60° C., and continued up to 150° C. The measurement time interval is set to be 30 seconds, the temperature rise is set to be 1° C./min, and the strain amount is set to be 0.3% so as to obtain the values of the complex elastic modulus and the mechanical loss tangent, and from the obtained values, the maximum value (tan $\delta_{p1}$) of the mechanical loss tangent when the complex elastic modulus is in a range of $1\times10^6$ Pa to $1\times10^8$ Pa, and the maximum value (tan $\delta_{P2}$) of the mechanical loss tangent when the complex elastic modulus is in a range of $1\times10^6$ Pa to $1\times10^7$ Pa are calculated.

The volume average particle diameter is measured using COULTER MULTISIZER TYPE II (manufactured by Beckman Coulter, Inc.) and ISOTON-II (manufactured by Beckman Coulter, Inc.) as the electrolytic solution. As a dispersion, 10 mg of a measurement sample is added into 2 ml of a 5 weight % aqueous solution of sodium dodecyl benzenesulfonate. The measurement sample added to 100 ml of the electrolytic solution is adjusted, and the electrolytic solution in which the measurement sample is suspended is dispersed for 1 minute by an ultrasonic disperser. Then, with COULTER MULTISIZER II, the particle diameter distribution of particles in a range of 2 μm to 60 μm is measured using an aperture having an aperture diameter of 100 μm to measure a volume average distribution. 50,000 particles are sampled. The cumulative distributions are drawn from the small particle side with respect to the particle diameter ranges (channels) separated based on measured particle distribution as the volume standard, and the particle diameter (D50v) when the cumulative percentage becomes 50% is defined as the volume average particle diameter of the measurement sample.

Evaluation

With the developer obtained in each example, the following evaluation is performed. The results are shown in Table 1.

A modifier is prepared by providing an image forming apparatus D136P (product name, manufactured by Fuji Xerox Co., Ltd.) with the multistage fixing-type fixing device (as illustrates in FIG. 2) as an image forming apparatus for forming an image for evaluation, a developer is put into a developing device, and a supply toner (which is the same as the toner contained in the developer) is put into a toner cartridge. Subsequently, 100,000 sheets of images including belt-shaped solid images each having a horizontal width of 100 mm, a vertical length of 400 mm are output, which sheets are thick papers (NCOLOR 209 gsm, product name, manufactured by Fuji Xerox Co., Ltd.,).

Evaluation of Offset (Attachment of Toner)

The occurrence degrees of the offset with respect to the pair of fixing rollers (heating and pressurizing member) at the first stage, and the offset with respect to the pair of fixing rollers (heating and pressurizing member) at the second stage are evaluated based on the following evaluation criteria by observing a state where a toner is scattered in a position corresponding to the position where band images are formed on the fixing rollers.

A: There is no difference in toner scatter state as compared with a part not having band images B: There is a slight difference in toner scatter state as compared with a part not having band images C: There is a difference in toner scatter state as compared with a part not having band images D: The occurrence of offset is found Evaluation of Image Glossiness Regarding the last output image, the glossiness is measured by using evaluation equipment (BYK-Gardner micro-TRI-gloss, 60° gloss).

TABLE 1

| | Toner | $\tan\delta_{P1}$ | $\tan\delta_{P2}$ | $\eta^*_{-30}$ | $\eta^*_{-10}$ | Volume average particle diameter [μm] | Evaluation Offset | Evaluation Glossiness |
|---|---|---|---|---|---|---|---|---|
| Comparative Example 1 | Toner 1 | 1.9 | 1.8 | $9 \times 10^8$ | $3 \times 10^7$ | 6.1 | B | 8 |
| Example 1 | Toner 2 | 2.0 | 1.9 | $8 \times 10^8$ | $1.8 \times 10^7$ | 6.2 | B | 22 |
| Example 2 | Toner 3 | 2.2 | 2.1 | $6 \times 10^8$ | $1 \times 10^7$ | 6.4 | A | 42 |
| Example 3 | Toner 4 | 2.2 | 2.1 | $2 \times 10^8$ | $4 \times 10^6$ | 6.4 | A | 33 |
| Example 4 | Toner 5 | 2.5 | 2.3 | $9 \times 10^7$ | $8 \times 10^5$ | 6.0 | C | 17 |
| Comparative Example 2 | Toner 6 | 2.6 | 2.5 | $5 \times 10^7$ | $5 \times 10^5$ | 6.1 | D | 31 |

From the above results, it is found that even with the multistage fixing method, the attachment of the toner (offset) is prevented with respect to the heating and pressurizing member in Examples as compared with Comparative Examples. In addition, it is also found that good glossiness is obtained in the image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charge unit that charges a surface of the image holding member;

an electrostatic latent image forming unit that forms an electrostatic latent image on a charged surface of the image holding member;

a developing unit that contains a developer containing toner, and develops the electrostatic latent image formed on the surface of the image holding member with a developer to form a toner image;

a transfer unit that transfers the toner image formed on the surface of the image holding member to a surface of a recording medium; and a fixing unit that includes a heating and pressurizing member, and fixes the toner image by performing the operation of heating and pressurizing to the toner image on the recording medium twice or more times with the heating and pressurizing member, wherein the toner contains a toner particle which contains a binder resin containing a crystalline polyester resin, a colorant, and a release agent, and an external additive, and satisfies the following Expression (1):

$$2 \leq \tan\delta_{P1} \leq 2.5 \quad (1)$$

wherein tan $\delta_{P1}$ represents a maximum value of a mechanical loss tangent existing in a range where a complex elastic modulus is from $1\times10^6$ Pa to $1\times10^8$ Pa, which is measured at an angular frequency of 6.28 rad/sec and a distortion amount of 0.3%.

2. The image forming apparatus according to claim 1, wherein the transfer unit is configured to include:

an intermediate transfer member of which the toner image is to be transferred to a surface;

a primary transfer unit that primarily transfers the toner image formed on the surface of the image holding member to the surface of the intermediate transfer member; and a secondary transfer unit that secondarily transfers the toner image transferred on the surface of the intermediate transfer member to the surface of the recording medium.

3. The image forming apparatus according to claim 1, wherein the maximum value (tan $\delta_{P1}$) of the mechanical loss tangent of the toner is from 2 to 2.3.

4. The image forming apparatus according to claim 1, wherein the toner satisfies the following Expression (2):

$$2 \leq \tan \delta_{P2} \leq 2.3 \quad (2)$$

wherein tan $\delta_{P2}$ represents a maximum value of a mechanical loss tangent existing in a range where a complex elastic modulus is from $1\times10^6$ Pa to $1\times10^7$ Pa, which is measured at an angular frequency of 6.28 rad/sec and a distortion amount of 0.3%.

5. The image forming apparatus according to claim 4, wherein the maximum value (tan $\delta_{P2}$) of the mechanical loss tangent of the toner is from 2 to 2.2.

6. The image forming apparatus according to claim 1, wherein a dynamic complex viscosity ($\eta^*_{-30}$) of the toner at a temperature of (a melting temperature of the crystalline polyester resin −30° C.) is $3\times10^7$ Pa·s or more, and a dynamic complex viscosity ($\eta^*_{-10}$) of the toner at a temperature of (a melting temperature of the crystalline polyester resin −10° C.) is from $1\times10^6$ Pa·s to $5\times10^7$ Pa·s.

7. The image forming apparatus according to claim 6, wherein the dynamic complex viscosity ($\eta^*_{-10}$) of the toner at a temperature of (a melting temperature of the crystalline polyester resin −10° C.) is from $2\times10^6$ Pa·s to $3\times10^7$ Pa·s.

8. The image forming apparatus according to claim 6, wherein the dynamic complex viscosity ($\eta^*_{-10}$) of the toner at a temperature of (a melting temperature of the crystalline polyester resin −10° C.) is from $4\times10^6$ Pa·s to $2\times10^7$ Pa·s.

9. The image forming apparatus according to claim 6, wherein the dynamic complex viscosity ($\eta^*_{-30}$) of the toner at a temperature of (a melting temperature of the crystalline polyester resin −30° C.) is $1\times10^8$ Pa·s or more.

10. The image forming apparatus according to claim 6, wherein the dynamic complex viscosity ($\eta^*_{-30}$) of the toner at a temperature of (a melting temperature of the crystalline polyester resin −30° C.) is $5\times10^8$ Pa·s or more.

11. The image forming apparatus according to claim 1, wherein the fixing unit performs an operation of heating and pressurizing for fixing, and an operation of heating and pressurizing for controlling glossiness of an image.

* * * * *